United States Patent [19]

Avocat

[11] 4,319,686

[45] Mar. 16, 1982

[54] SKI HOLDER

[76] Inventor: Marcel A. Avocat, Place de l'Eglise, Areches (Savoie), France

[21] Appl. No.: 96,495

[22] Filed: Nov. 21, 1979

[30] Foreign Application Priority Data

Nov. 23, 1978 [FR] France ..... 78 34037

[51] Int. Cl.[3] ..... A47F 7/00

[52] U.S. Cl. ..... 211/60 SK; 248/246; 280/814

[58] Field of Search ..... 211/60 SK, 99, 64, 201, 211/81; 280/814; 224/917; 24/248 R; 248/313, 316 F, 316 A, 246, 316 C, 297.5

[56] References Cited

U.S. PATENT DOCUMENTS 2,919,032 12/1959 Sinawski ..... 211/60 SK
2,963,165 12/1960 Steiner ..... 211/60 SK
3,673,615 7/1972 Ellis ..... 248/246 X
4,252,337 2/1981 Luithler ..... 280/814

*Primary Examiner*—Roy D. Frazier
*Assistant Examiner*—Robert W. Gibson, Jr.
*Attorney, Agent, or Firm*—Karl F. Ross

[57] ABSTRACT

A ski holder comprises a vertically elongated and fixed U-section guide adjacent which a vertically elongated and movable U-section guide having a lower end provided with an abutment projecting toward the fixed guide can move. A pair of links forms a parallelogrammatic linkage with these guides for relative parallel movement. A spring urges the movable guide from a lower closed position spaced relatively close to the fixed guide into an upper open position spaced horizontally relatively far from the fixed guide. A ski set on the abutment will automatically cause the movable guide to pivot downwardly and inwardly on its links so as to clamp and hold the ski.

10 Claims, 4 Drawing Figures

FIG. 1
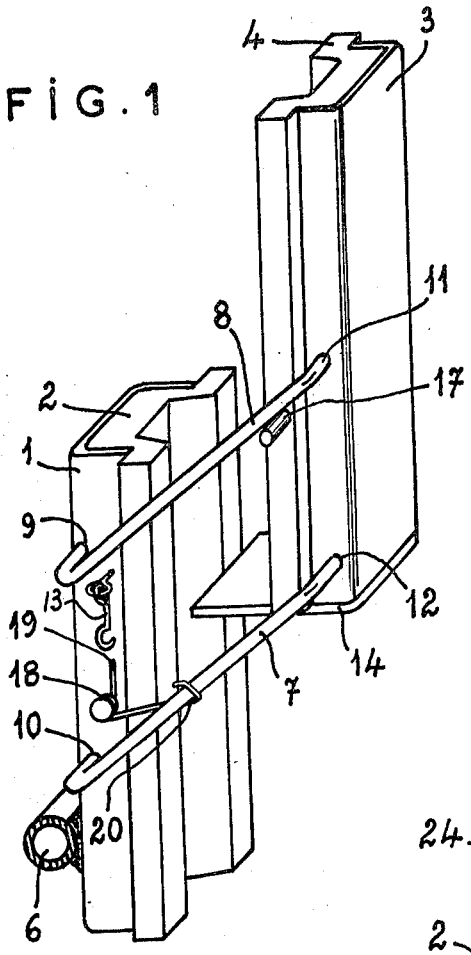
FIG. 2
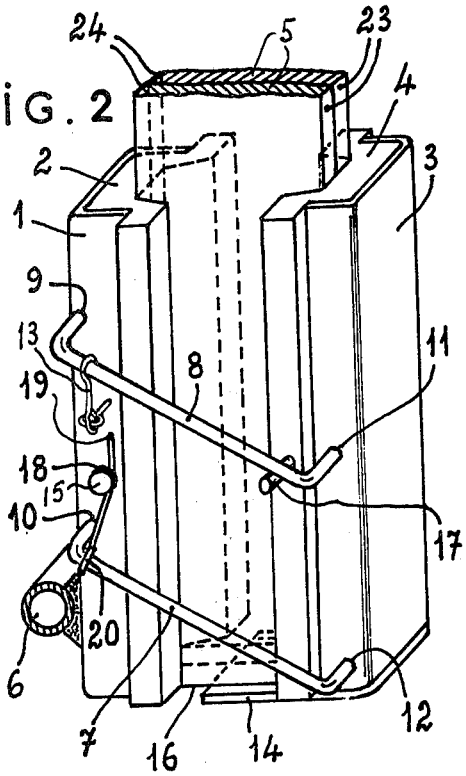
FIG. 3
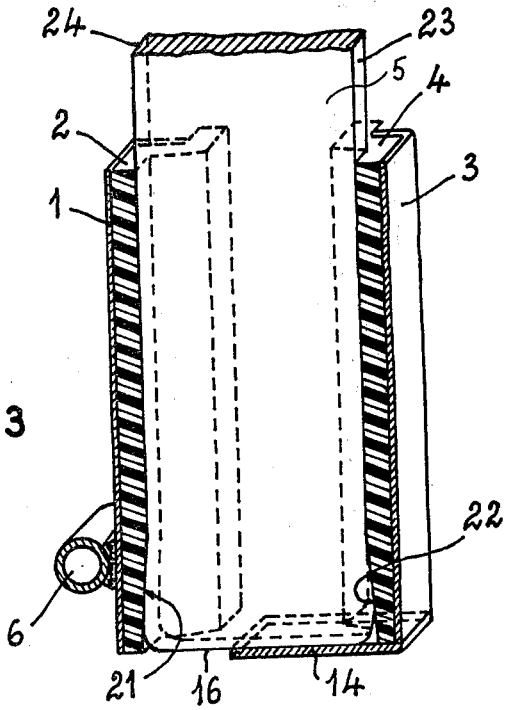
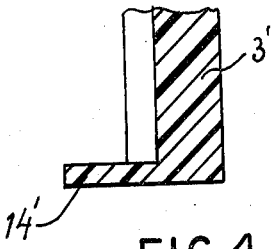
FIG. 4

SKI HOLDER

FIELD OF THE INVENTION

The present invention relates to a ski holder. More particularly this invention concerns such a holder for a pair of skis on a rack.

BACKGROUND OF THE INVENTION

Skis are relatively large and cumbersome objects which are relatively difficult to store neatly. In particular when a great many skis must be temporarily stored, as in a cafeteria on a ski slope or in an establishment that rents and sells skis, maintaining the many skis in neat order is a relatively difficult task. The standard arrangement is a simple rack having a plurality of forks each adapted to receive a respective pair of skis. Such a rack normally is provided on wheels for transport of the skis from one location to another, and the forks are normally staggered in alternate rows.

Such an apparatus is relatively inconvenient in that the skis are held relatively loosely and frequently overlap and cross one another. Normally it is relatively difficult to remove any pair of skis that is not immediately adjacent an edge, due mainly to the fact that the skis can tip in the respective forks which must be made large enough so that the user can easily fit the skis into them. What is more the skis must be lifted a relatively great distance to remove them from such a rack.

OBJECTS OF THE INVENTION

It is therefore an object of the present invention to provide an improved ski holder.

Another object is to provide such a holder which securely and tightly holds a pair of skis in an exact position, so that a plurality of such holders can be mounted immediately adjacent one another on a rack without adjadent pairs of skis criss-crossing and interfering with one another.

Still another object is to provide such a holder which will not damage or mar a pair of skis, and from which it is relatively easy to remove the skis, without having to lift them too high.

SUMMARY OF THE INVENTION

These objects are attained according to the instant invention in a ski holder having a vertically elongated and fixed guide and a vertically elongated and movable guide adjacent the fixed guide and having a lower end provided with an abutment projecting toward the fixed guide. Means including a link extends between the guides for displacement of the movable guide parallel to the fixed guide between an upper open position spaced horizontally relatively far from the fixed guide and a lower closed position spaced horizontally relatively close to the fixed guide. Biasing means including a spring urges the movable guide upwardly with a force substantially less than the weight of a single standard ski. Furthermore when the movable guide is in the upper open position it is spaced horizontally from the fixed guide by a distance equal to somewhat more than the width of a standard ski.

Thus the heel end of a ski can be fitted down between the two guides in the open position thereof and the heel of the ski can be set on the abutment. The weight of the ski thereafter will move the movable guide downwardly and, eventually, inwardly to clamp the ski against the fixed guide.

According to this invention the device has two such links spaced vertically apart and parallel to each other so as to form with the guides a parallellogrammatic linkage. Thus one or two skis clamped between the guides will be securely held. When a plurality of such holders is provided on a rack it is possible to mount them relatively close to each other, the skis will be positively gripped and, therefore, perfectly parallel to one another. This effect is enhanced according to the invention by forming the two guides of U-section, open toward each other, so that the skis are perfectly centered on respective vertical axes. As a result it is possible to grip the skis only at their heel ends, and still maintain the skis in a perfect upright position. A rack according to this invention can therefore be relatively low to the ground and, when empty, relatively small and unobtrusive. What is more it is possible to remove a pair of skis from its holder simply by lifting the respective pair of skis so as to ungrip it, and in fact raising the pair of skis 6–8 inches is normally sufficient to pull it completely out of the holder.

Each of the guides may be consituted according to this invention as a single molded piece of synthetic-resin material, with the abutment on the fixed guide formed as an integral part thereof. It is also possible to form each of the guides as a metal channel provided with a U-section synthetic-resin liner cushion so as to avoid marring the skis, wile still having excellent physical strength.

A rack can carry a plurality of such holders in a row, in several staggered rows, or in any other type of geometric pattern. The guides are shaped to conform to the dimensions of a standard ski, it being understood that skis have certain maximum and minimum length, width, and thickness dimensions.

BRIEF DESCRIPTION OF THE DRAWING

FIG. 1 is a perspective view of a holder according to this invention in the open position;

FIG. 2 is a perspective view of the holder in the closed position;

FIG. 3 is a vertical section through the holder as seen in FIG. 2; and

FIG. 4 is a section through a detail of a movable guide according to this invention.

SPECIFIC DESCRIPTION

As seen in the drawing a ski holder basically comprises a fixed guide comprised as a fixed channel 1 provided with a U-section liner 2, and a movable guide constituted as a vertically movable channel 3 provided with a U-section synthetic-resin liner 4. The guide 1 is fixed on a support 6 which can form part of a rack having a plurality of such holders.

Two parallel links 7 and 8 each have one end 9 and 10 pivoted in the fixed guide 1 and another end 11 and 12 pivoted in the movable guide 3, so that the links 7 and 8 form with the guides 1 and 3 a parallelogrammatic linkage. The movable guide 3 is provided at its lower end with a welded-on horizontal plate 14 extending toward the fixed guide 1.

A torque spring 18 wound about a pin 15 in the fixed guide 1 has one leg 19 seated in the guide 1 and another leg 20 hooked over the lower link 7 so as to urge the movable guide 3 upwardly. A stop pin 17 provided on the movable guide 3 can engage under the upper link 8 and define therefore a maximum upper limit of travel for the movable guide 3. In addition the fixed guide 1 is provided with a latch hook 13 that can be engaged over the upper link 8 in the lower closed position shown in FIG. 2.

In use two skis 5 are engaged downwardly with their heels 16 against the plate 14 of the movable guide 3 in the upper position of FIG. 1. The spring force of the spring 18 is effective on the movable guide 3 with a force substantially less than the weight of even a single ski 5, so that the weight of the skis 5 alone will pivot the movable guide 3 downwardly and inwardly into the position of FIG. 2, when the grooves 21 and 22 formed by the U-section liner cushions 2 and 4 engage the lateral edges 23 and 24 of the skis 5. Once the skis 5 are tightly clamped downward displacement of the movable guide 3 stops, and the hook 13 can be engaged over the link 8 to hold the skis 5 tightly in place.

FIG. 4 shows an arrangement wherein a movable guide 3′ is formed entirely of synthetic-resin material and an abutment 14′ equivalent to abutment 14 is formed integrally with this movable guide 3′.

With the system according to the instant invention, therefore, the user need merely rest one or two skis in the holder, which will then automatically close on the skis and hold them relatively snugly, nonetheless without marring them as the liners 2 and 4 are of a synthetic-resin material which is substantially softer than the fiberglass-reinforced resin that constitutes the skis. Even though the skis are clamped tightly by the holder according to this invention, however, the user need merely lift them somewhat to make the holder automatically open up and release them. The skis are, nonetheless, so tightly held that the holder need merely engage the lower 6 inches or so of the ski to hold it in a perfect upright position, so that a plurality of such holders can be mounted adjacent one another without the pairs of skis criss-crossing one another from adjacent holders.

I claim:

1. A ski holder comprising:

a vertically elongated and fixed guide;

a vertically elongated and movable guide adjacent said fixed guide and having a lower end;

an abutment on said lower end projecting toward said fixed guide;

means including a link extending between said guides for displacement of said movable guide parallel to said fixed guide between an upper open position spaced horizontally relatively far from said fixed guide and a lower closed position spaced horizontally relatively close to said fixed guide.

2. The holder defined in claim 1 wherein said means includes a pair of parallel links having ends pivoted in said guides and forming therewith a parallelogram in and between both of said positions.

3. The holder defined in claim 2 wherein said guides are of U-section and open toward each other, said guides being spaced horizontally apart in said open position by a distance equal to more than the width of a standard pair of skis.

4. The holder defined in claim 3 wherein each of said guides has a liner cushion on its side facing the other guide.

5. The holder defined in claim 3 wherein each of said guides is unitarily formed of synthetic-resin material and said abutment is unitarily formed of said material with said movable guide.

6. The holder defined in claim 3 wherein each of said guides forms a groove open toward the other guide and having the dimensions of the edges of the heel of a standard pair of skis.

7. The holder defined in claim 1, further comprising a spring connected to one of said guides for urging said guides into said open position.

8. The holder defined in claim 1, further comprising latch means for locking said guides in said closed position.

9. The holder defined in claim 1, further comprising means including a spring for urging said movable guide upwardly into said open position with a force substantially less than the weight of a standard ski.

10. The holder defined in claim 1 wherein said means includes a stop engageable with said link in said upper open position.

* * * * *